United States Patent [19]

Hafele et al.

[11] 4,120,261

[45] Oct. 17, 1978

[54] ELECTROSTATIC COATING SYSTEM

[75] Inventors: Joseph C. Hafele; Thomas J. Richards; Paul L. Wright, all of Peoria, Ill.

[73] Assignee: Caterpillar Tractor Co., Peoria, Ill.

[21] Appl. No.: 855,060

[22] Filed: Nov. 25, 1977

[51] Int. Cl.[2] ..... B05B 5/02

[52] U.S. Cl. ..... 118/630; 118/635

[58] Field of Search ..... 118/629, 630, 631, 632, 118/633, 634, 635

[56] References Cited

U.S. PATENT DOCUMENTS

| | | | |
|---|---|---|---|
| 2,247,963 | 7/1941 | Ransburg et al. | 118/DIG. 7 |
| 2,463,422 | 3/1949 | Ransburg et al. | 118/634 X |
| 3,113,037 | 12/1963 | Watanabe | 118/635 X |
| 3,376,156 | 4/1968 | Whitaker et al. | 118/635 X |
| 3,418,971 | 12/1968 | Lamm | 118/630 X |
| 3,900,000 | 8/1975 | Gallen | 118/630 |

*Primary Examiner*—Mervin Stein

*Attorney, Agent, or Firm*—Wegner, Stellman, McCord, Wiles & Wood

[57] ABSTRACT

An electrostatic coating system in which the workpiece to be coated is charged to a high DC potential. A conveyor moves the workpiece through the coating zone past a charged conductor. A suspended workpiece support includes a swivel joint to accommodate tilt and sway of the workpiece. A charge collector on the support has a spherically contoured surface which swings from the swivel joint so that the spacing of the collector from the conductor is substantially constant, stabilizing the voltage induced on the workpiece and minimizing the danger of sparking.

12 Claims, 3 Drawing Figures

ELECTROSTATIC COATING SYSTEM

BACKGROUND OF THE INVENTION

An electrostatic coating system is known in which workpieces moved by a conveyor through a coating zone are charged by inducing a voltage from a charged wire adjacent the path of the workpiece support. A circular disc collector on the support travels through the field adjacent the charged wire. Swinging or tilting of the workpiece support changes the distance between the collector and the charged wire. This varies the induced voltage on the workpiece and may adversely affect the quality of the coating. If the charge collector or other portions of the workpiece support approach the charged wire too closely, sparking may occur.

SUMMARY OF THE INVENTION

The present invention is directed to overcoming one or more problems as set forth above.

According to the present invention, an improved workpiece charging system includes a workpiece support to move the workpiece through the coating zone and having a swivel joint therein. A charge collector on the support has a convex spherically contoured surface presented to the charged conductor, the spherically contoured surface swinging from the swivel joint so that the spacing between the charge collector surface and the charged conductor is substantially constant.

Further features and advantages of the invention will readily be apparent from the following description and from the drawings, in which.

Figure 1:
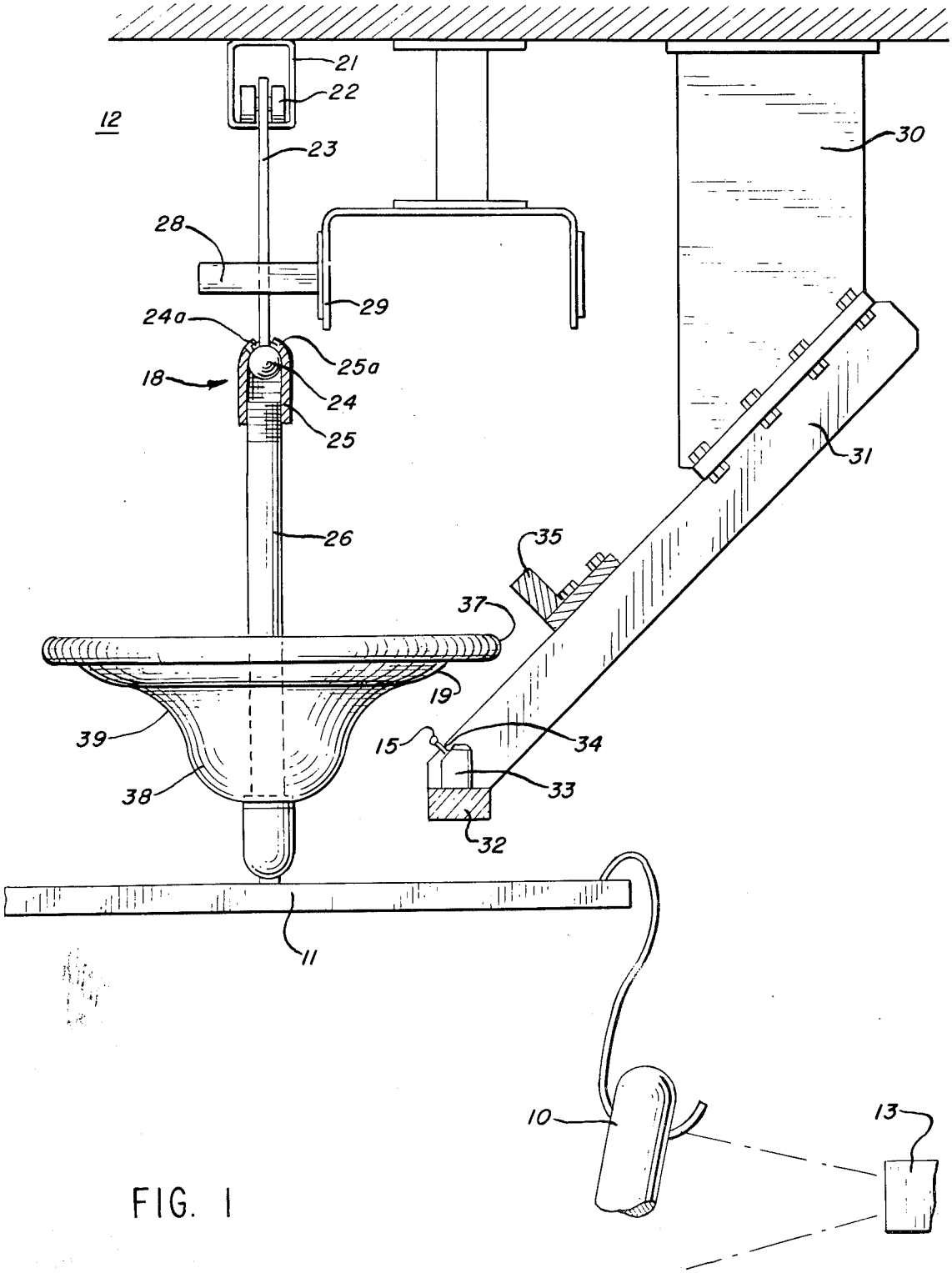
FIG. 1 is a section at right angles to the conveyor illustrating the workpiece support and charging system.
Figure 2:
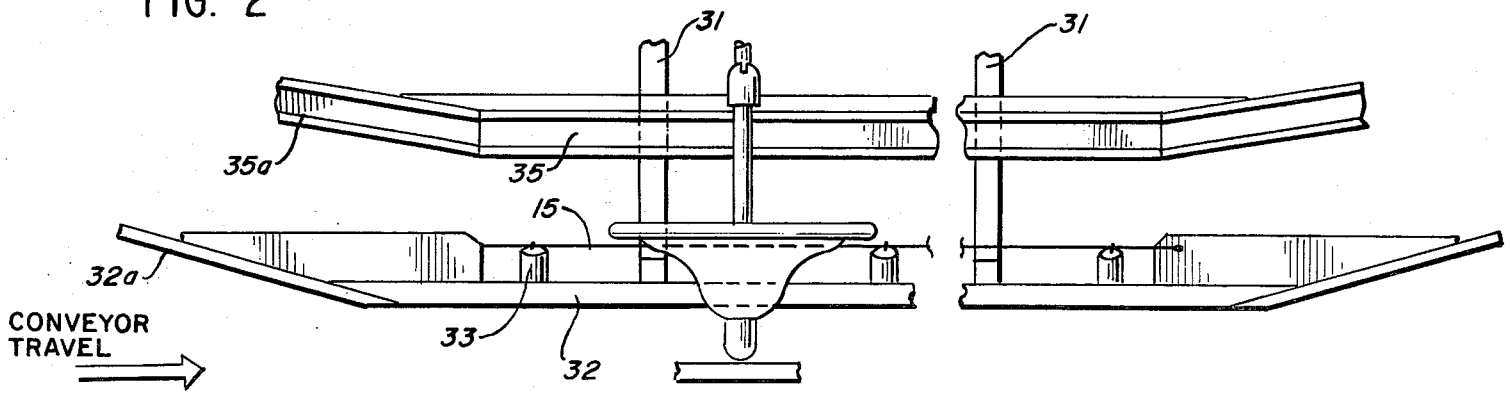
FIG. 2 is a broken elevation, looking from the left in FIG. 1.
Figure 3:
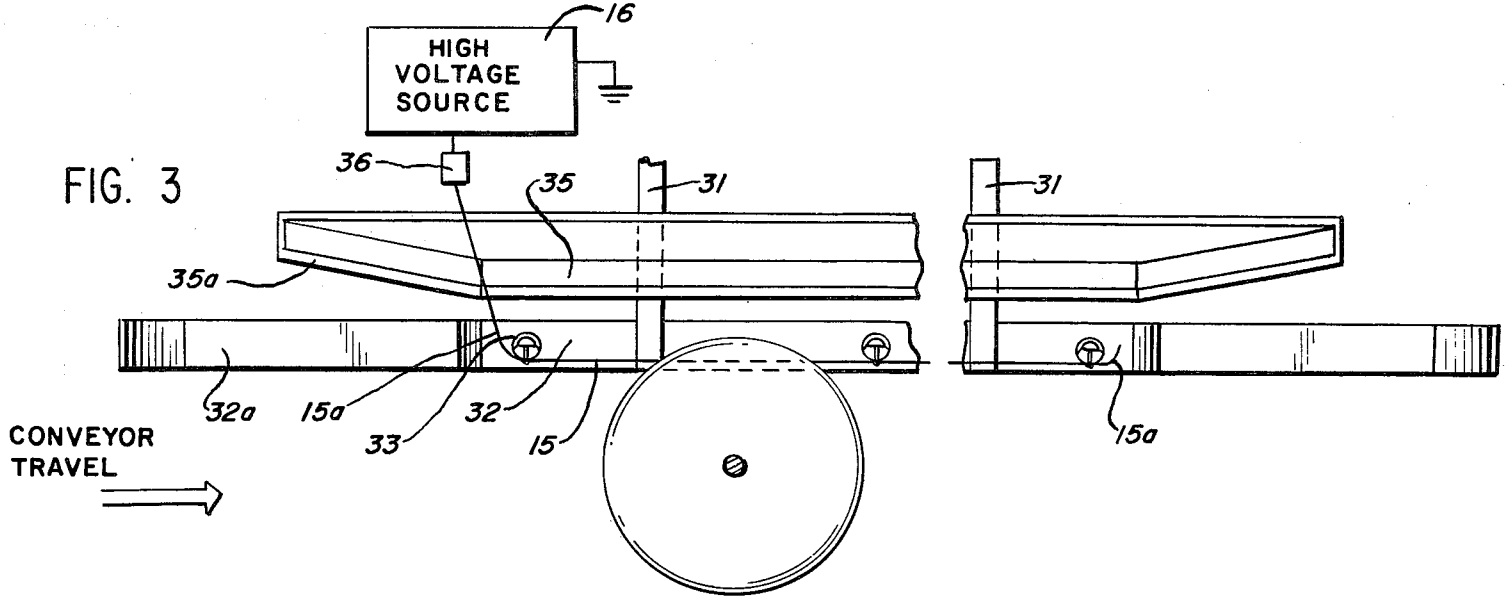
FIG. 3 is a broken plan view thereof.

This invention is particularly suited for a coating system in which the workpieces to be coated are moved through the coating zone on a support that may swing or tilt with movement of the conveyor or unbalance of the workpieces. As best seen in FIG. 1, workpiece 10 is suspended from rack 11 carried by a conveyor 12 through a coating zone and past a spray gun 13. Charge collector 14 extends into the electric field around wire 15 which is connected with a source 16 of high voltage (FIG. 3). An electric potential is induced on the collector 14 and connected through the rack 11 to workpiece 10. The electric potential on the workpiece is an important factor in the electrostatic deposition of coating material. If the spacing between collector 14 and charged wire 15 varies, the induced potential on workpiece 10 varies and the quality of the coating may be adversely affected. Further details of the coating system with which the invention may be utilized are disclosed in Bagby et al United States patent application Ser. No. 678,844, filed Apr. 21, 1976.

The workpiece support includes a swivel joint 18 to accommodate tilt and swing of rack 11 and workpiece 10. In accordance with the invention, collector 14 has a convex spherically contoured surface 19 presented to charged wire or conductor 15, which swings about joint 18 so that the distance between collector 14 and conductor 15 is substantially constant and variation of the induced voltage is minimized.

The coating system is illustrated with a conveyor having a grounded overhead track 21 in which wheeled carrier 22 is moved, as by a chain (not shown). An upper support rod 23 is suspended from wheeled carrier 22 and has at its lower end the swivel joint 18. Preferably the joint includes male ball member 24 at the end of support rod 23 which mates with female socket member 25. Lower support rod 26 depends from female joint member 25 and charge collector 14 is secured at its lower end. Rod 26 has a high resistance to complete the charging circuit and to drain the charge from the workpiece and rack through the conveyor to ground when collector 14 leaves the field of wire 15. It is often desirable that the workpiece support be rotated as it passes through the coating zone so that all of the workpieces are exposed to the coating material. Support rod 23 is rotatable in carrier 22 and has thereon a drive wheel 28 which engages a driving surface 29 to rotate the entire support assembly. Joint members 24, 25 have interengaging surfaces, as shoulders **24*a* which are received in slots 25*a* to transmit rotation from upper support rod 23 to lower support rod 26**.

Charged wire 15 is mounted on a framework of insulating material including hangers 30, 31 and a base plate 32. Insulators 33 are secured to base plate 32 and each has extending therefrom a pin 34 with an eye at the end through which wire 15 is threaded and suitably secured in place, as by solder. Wire 15 is below and at the side of cup-shaped collector 14; and pin 34 is positioned to extend away from the collector surface so that wire 15 is the closest charged element to the collector. A stop plate 35 is mounted on hangers 31 for engagement by the edge of collector 14 to limit the swing of the workpiece support. Base plate 32 and stop plate 35 have inclined sections **32*a*, 35*a*, respectively, to restrict violent swinging of the workpiece support as it enters the coating zone. The end portions 15*a* of the wire are curved away from the conveyor path to avoid the high voltage gradient which would occur at a sharp bend. A current limiting resistor 36 is connected between the wire and high voltage source 16**.

Charge collector 14 is of sheet metal. The spherical surface 19 is less than a hemisphere and the upper edge 37 is rolled so that no sharp corner is exposed, which would cause a high potential gradient and corona discharge. The central portion of spherical surface 19 blends into a downwardly extending cylindrical surface 38 which surrounds the lower end of resistance supporting rod 26. The supporting rod is connected with the charge collector at the lower end of the cylindrical surface. This construction is preferable to that of a collector which is merely spherical as the spacing between spherical surface 19 and rack 11 is increased without increasing the overall vertical dimension of the workpiece support. Charged wire 15 is spaced from rack 11 to avoid inadvertent sparking between them, even if the rack is tilted as by an unbalanced load. The spacing between charged wire 15 and cylindrical surface 38 with collector 14 displaced at a maximum angle (in engagement with stop 35) is at least as great as the spacing between charged wire 15 and spherical surface 19. In addition, the surface 39 joining spherical surface 19 with cylindrical surface 38 is concave outwardly and has a radius equal to the minimum spacing between the cylindrical surface 38 and charged wire 15.

In a typical system the spherical surface 19 of the charge collector has a radius of 280 mm. The cylindrical surface 38 has a diameter of 115 mm. The nominal spacing of the collector from charged wire 15 is 50 mm. With a voltage of 90 KV on wire 15 and a resistance in support rod 26 of $10^3$ megohms, a voltage of 60 KV is induced on the collector and workpiece 10. The voltage variation with movement of the collector is less than 2 KV.

The embodiments of the invention in which an exclusive property or privilege is claimed are defined as follows:

1. In a coating system in which a workpiece at a high electrostatic potential is moved by conveyor through a coating zone, an improved workpiece charging system comprising:

a workpiece support to move the workpiece through the coating zone and having a swivel joint therein;

a conductor extending through the coating zone adjacent the path of said support;

a source of DC potential connected with said conductor to establish a charging field; and a charge collector on said support having a spherically contoured surface with a convex face presented to said charged conductor, said spherically contoured surface swinging from said swivel joint with the spacing of said charge collector surface from said charged conductor substantially constant.

2. The charging system of claim 1 in which said workpiece support is suspended from above with said swivel joint above said charge collector and said conductor is below said spherically contoured surface, offset to one side of the center thereof and extends generally parallel with the path of support travel through the coating zone.

3. The charging system of claim 1 in which said spherically contoured charge collector is less than a hemisphere and is of sheet metal and has a circular edge which is rolled to present a curved surface in the field of said charged conductor, minimizing corona discharge.

4. The charging system of claim 3 in which said charge collector edge is rolled outwardly.

5. The charging system of claim 1 in which the central portion of said spherically contoured surface blends into a cylindrical surface extending outwardly therefrom; and said workpiece support includes a support rod extending from the end of said cylindrical surface to said swivel joint.

6. The charging system of claim 5 including a mechanical stop for limiting movement of said cylindrical extension toward said charged conductor and in which said charge collector has a concave surface joining the spherical and cylindrical surfaces, said concave surface having a radius equal to the minimum spacing between the cylindrical surface and the charged conductor.

7. The charging system of claim 6 in which said minimum spacing between the cylindrical surface and the charged conductor is equal to the fixed spacing between the spherically contoured surface and the charged conductor.

8. The charging system of claim 1 in which said swivel joint includes a ball member and a complementary socket member substantially concentric with said spherically contoured surface, said ball and socket members having interengaging surfaces for imparting rotation through the support to said charge collector and to a workpiece carried by said support.

9. In a coating system in which a workpiece at a high electrostatic potential is moved by a conveyor through a coating zone, an improved workpiece support and charging system, comprising:

an overhead conveyor for moving a workpiece through the coating zone;

a conductor extending through the coating zone adjacent the path of the conveyor;

a source of DC potential connected with said conductor to establish a charging field;

a depending workpiece support connected with said conveyor and including a swivel joint with a support rod extending downwardly therefrom;

a charge collector mounted at the lower end of said rod, said charge collector having a downwardly presented convex spherical surface located above and to the side of said conductor, the joint and spherical surface being concentric so that the spacing between the charge collector surface and the conductor is constant; and a workpiece carrier below said charge collector, from which a workpiece is suspended.

10. The charging system of claim 9 in which the central portion of said spherical surface blends into a downwardly extending cylindrical surface surrounding the lower end of said support rod.

11. The charging system of claim 10 including a stop for limiting the movement of the workpiece support toward the charged conductor, with a concave surface joining the spherical and cylindrical surfaces of the charge collector, having a radius equal to the minimum spacing between the cylindrical surface and the charged conductor.

12. The charging system of claim 11 in which said minimum spacing between the cylindrical surface and the charged conductor is equal to the fixed spacing between the spherical surface and the charged conductor.

* * * * *